US007732690B2

(12) United States Patent
Miyaoka

(10) Patent No.: US 7,732,690 B2
(45) Date of Patent: Jun. 8, 2010

(54) WOODWIND INSTRUMENT AND MANUFACTURING METHOD OF PIPE THEREOF

(75) Inventor: Shinri Miyaoka, Iwata (JP)

(73) Assignee: Yamaha Corporation, Shizuoka-Ken (JP)

( * ) Notice: Subject to any disclaimer, the term of this patent is extended or adjusted under 35 U.S.C. 154(b) by 106 days.

(21) Appl. No.: 12/046,047

(22) Filed: Mar. 11, 2008

(65) Prior Publication Data

US 2008/0223193 A1 Sep. 18, 2008

(30) Foreign Application Priority Data

Mar. 13, 2007 (JP) ..... 2007-063752

(51) Int. Cl.
*G10D 7/06* (2006.01)

(52) U.S. Cl. ..... 84/380 R

(58) Field of Classification Search ..... 84/382, 84/384, 385 R, 387 R, 380 R
See application file for complete search history.

(56) References Cited

U.S. PATENT DOCUMENTS

| | | | | |
|---|---|---|---|---|
| 2,596,260 | A | 5/1952 | Linton | |
| 2,730,003 | A * | 1/1956 | Loney | 84/380 R |
| 3,308,706 | A | 3/1967 | Brilhart | |
| 5,686,680 | A | 11/1997 | Laurence | |
| 2003/0192421 | A1* | 10/2003 | Ahrens | 84/380 R |
| 2007/0207186 | A1* | 9/2007 | Scanlon et al. | 424/424 |

FOREIGN PATENT DOCUMENTS

| | | |
|---|---|---|
| DE | 29380 | 11/1884 |
| DE | 48160 | 7/1889 |
| FR | 2.202.775 | 5/1975 |
| FR | 2701420 | 8/1994 |
| FR | 2718271 A1 | 10/1995 |
| FR | 2 884 958 | 10/2006 |
| JP | 09-218679 | 8/1997 |
| JP | 2001-269941 | 10/2001 |
| JP | 2003-345344 | 3/2003 |

OTHER PUBLICATIONS

Yamaha Corporation in Japan, Catalogue entitled "Clarinets" published on Apr. 2006.
"Oboe" manufactured by Laubin Co. in U.S.
Buffet-Crampon Co. in France, which presents "Clarinets (Luracast)" for intermediate players.
Paul Covey Co. in U.S., Catalog of "Oboe".
European Search Report, dated Jun. 5, 2008.

* cited by examiner

*Primary Examiner*—Kimberly R Lockett
(74) *Attorney, Agent, or Firm*—Dickstein Shapiro LLP

(57) ABSTRACT

A pipe of a woodwind instrument (e.g., an upper joint of an oboe) having a through-hole running therethrough in its longitudinal direction is produced in such a way that a plastic lining layer composed of a thermoplastic material is formed on the interior wall of the pipe and the circumferential surfaces of tone holes of the pipe. The thermoplastic material is selected from generally-known plastic materials such as polyethylene, polypropylene, polystyrene, ABS resin, and POM resin. This prevents the inside of the pipe from being excessively expanded due to a player's moist breath in playing the woodwind instrument; hence, it is possible to prevent cracks or flaws from occurring on the pipe. In addition, this structure is superior in manufacturability and suited to mass production.

2 Claims, 2 Drawing Sheets

WOODWIND INSTRUMENT AND MANUFACTURING METHOD OF PIPE THEREOF

BACKGROUND OF THE INVENTION

1. Field of the Invention

The present invention relates to woodwind instruments and manufacturing methods of bodies of woodwind instruments.

The present application claims priority on Japanese Patent Application No. 2007-63752, the content of which is incorporated herein by reference.

2. Description of the Related Art

Conventionally, woodwind instruments have been manufactured by various companies and disclosed in various documents (or catalogues) such as Non-Patent Documents 1-4.

Non-Patent Document 1: Yamaha Corporation in Japan, Catalogue entitled "Clarinets" published on April, 2006.

Non-Patent Document 2: "Oboe" manufactured by Laubin Co. in U.S. (no catalogue is presented because it is a small-scale manufacturer run by family members for manufacturing products only to order).

Non-Patent Document 3: Buffet-Crampon Co. in France, which presents "Clarinets (Luracast)" for intermediate players.

Non-Patent Document 4: Paul Covey Co. in U.S., Catalog of "Oboe".

Conventionally, pipes of woodwind instruments such as clarinets, oboes, and piccolos are manufactured by way of cutting work of wooden materials such as rosewood and grenadilla wood which grow in African countries (see Non-Patent Document 1). Non-Patent Document 2 presents combinations of wood and other materials for use in pipes of woodwind instruments, in which resin pipes (or ebonite pipes) are bonded with wood pipes, for example. Non-Patent Document 3 teaches that epoxy resins are introduced into pipes and then chemically solidified. Alternatively, FRP resin layers (i.e., "FR278271: Rigoutat", not actually realized) are formed on the interior walls of pipes, or wooden powders kneaded with resins (i.e., "FR2701420 (B1): Buffet Green-Line") are subjected to high pressure molding, thus producing pipes. Non-Patent Document 4 teaches that resins (or plastics) are embedded in and bonded with tone holes of pipes.

In the conventionally-known woodwind instruments, particularly, woodwind instruments having wood pipes, the inside spaces of pipes are expanded due to moisture content included in a player's breath, while the exterior surfaces of pipes are subjected to a low-humidity atmosphere and are thus dried and contracted, so that tensile stress occurs on the exterior surfaces of pipes in circumferential directions; this may cause cracks and flaws.

In the conventionally-known woodwind instruments whose pipes are formed by bonding resin pipes (or ebonite pipes) and wood pipes together, it is very troublesome to produce pipes, which increases the manufacturing cost. Ebonite materials display good sound quality but have very low cutting property; hence they are not suited to mass production.

In the conventionally-known woodwind instruments in which epoxy resins are inserted into pipes and are then chemically solidified, it takes a long time to solidify epoxy resins, and epoxy resins in liquid states before solidification are very difficult to handle. Therefore, there are difficulties in manufacturing.

The conventionally-known woodwind instruments, in which resin layers are formed on the interior walls of pipes, may have problems in manufacturing and sound quality; hence, they have not been put to practical use yet.

The conventionally-known woodwind instruments, in which wood powders kneaded with resins are subjected to high pressure molding, may have isotropic orientations of wooden fibers; hence, they cannot match woodwind instruments having wood pipes in sound quality. No cracks or flaws may occur due to playing, however, they have vulnerability because they may be easily destroyed when dropped or suffer an impact. In addition, they are degraded in cutting property.

The conventionally-known woodwind instruments, in which resins are embedded in tone holes, are very troublesome to manufacture due to the difficulty of bonding resins in connection with tone holes individually. In addition, embedded resins may easily fall out from tone holes due to bonding failures. Whilst they may reduce work in repairing cracks, they may have low crack prevention effects.

SUMMARY OF THE INVENTION

It is an object of the present invention to provide a woodwind instrument, which can reduce absorption of water due to breathing into a pipe and which is superior in manufacturing ability.

It is another object of the present invention to provide a manufacturing method of a pipe of a woodwind instrument, which is superior in manufacturing ability and which is suited to mass production.

In a first aspect of the present invention, a plastic lining layer composed of a thermoplastic material is formed on the interior wall of a pipe of a woodwind instrument (e.g., an upper joint of an oboe). The plastic lining layer is integrally formed on the circumferential surfaces of tone holes in connection with the interior wall of the pipe. The thermoplastic material is selected from among polyethylene, polypropylene, polystyrene, ABS resin, and POM resin.

In a second aspect of the present invention, a pipe of a woodwind instrument is produced in such a way that a main body having a through-hole running therethrough in its longitudinal direction is formed such that the interior diameter thereof is larger than the interior diameter of the pipe, and the external diameter of the main body is substantially identical to the external diameter of the pipe; a mandrel having a rod-like shape whose diameter substantially matches the internal diameter of the pipe is inserted into the longitudinal through-hole of the main body such that the axial line thereof substantially matches the axial line of the main body; a melted thermoplastic material is injected into a cavity formed between the interior wall of the main body and the exterior surface of the mandrel; the melted thermoplastic material is hardened so as to form a plastic lining layer on the interior wall of the main body; then, the mandrel is extracted from the main body.

In the above, a plurality of precut tone holes are formed at prescribed positions of the main body and filled with the melted thermoplastic material; then, after extracting the mandrel from the main body, the melted thermoplastic resin, which is hardened and embedded in the plurality of precut tone holes, are extracted so as to form a plurality of tone holes of the pipe.

The present invention presents the following effects.

1. Due to the formation of the plastic lining layer on the interior surface of the pipe, it is possible to reduce absorption of water and humidity due to a player's breath in playing a woodwind instrument. This prevents the inside of the pipe from being excessively expanded and also prevents tensile stress from occurring on the exterior surface of the pipe in its circumferential direction; hence, it is possible to avoid the occurrence of cracks and flaws in the pipe of a woodwind instrument.

2. Since variations of the internal diameter of the pipe are suppressed, it is possible to stably maintain desired performance of a woodwind instrument.
3. Due to a reduction of fluctuation caused by inconsistent moisture distribution within the pipe, it is possible to improve operating precision of a key mechanism attached to the exterior surface of the pipe in a stable manner.
4. Due to lining of the circumferential surfaces of the tone holes, it is possible to secure a desired planarity with respect to upper surfaces of tone holes, which come in contact with pads, without being affected by grains or warping of the pipe. This makes it possible to close tone holes by pads, which come in contact with the upper surfaces of tone holes in an airtight manner. This guarantees high airtight performance between pads and tone holes in wood pipes similar to plastic pipes.
5. Compared with a thermosetting material, the thermoplastic material is superior in molding ability and suitability to mass production; hence, it is possible to easily produce pipes of woodwind instruments using the thermoplastic material with a relatively low manufacturing cost.
6. When the partial volume ratio of the plastic lining layer within the total volume of the pipe is set to 10% or so, it is possible to realize a very good sound quality by use of the wood pipe compared with the plastic pipe.
7. The pipe having the plastic lining layer is mainly composed of an exterior wooden material, which cannot be visually distinguished from conventionally-known wood pipes in appearance; hence, this provides an authentic feeling or look for players or the audience in playing woodwind instruments according to the present invention.

BRIEF DESCRIPTION OF THE DRAWINGS

These and other objects, aspects, and embodiments of the present invention will be described in more detail with reference to the following drawings, in which.

DESCRIPTION OF THE PREFERRED EMBODIMENT

The present invention will be described in further detail by way of examples with reference to the accompanying drawings.

Figure 1:
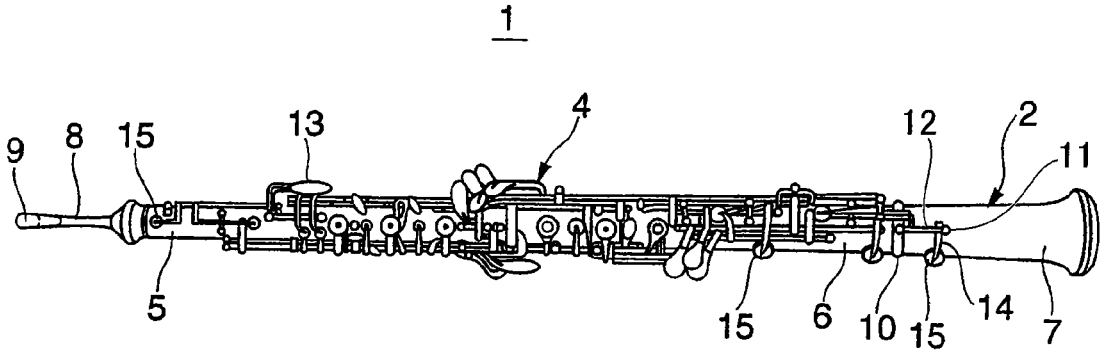
FIG. 1 is an illustration showing the exterior appearance of an oboe in accordance with a preferred embodiment of the present invention.
Figure 2:
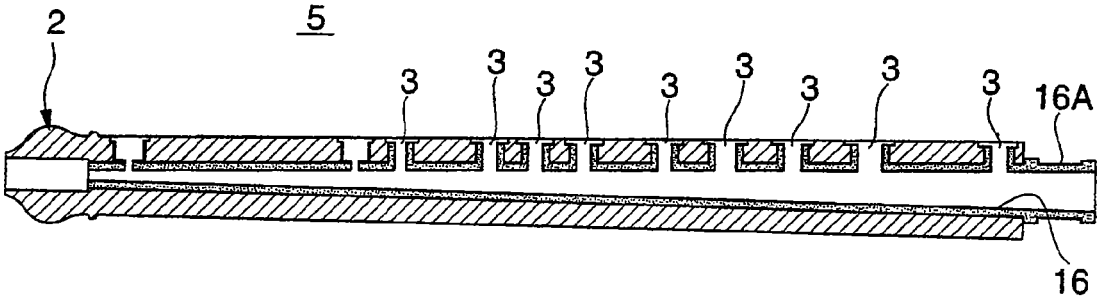
FIG. 2 is a longitudinal sectional view showing an upper joint of a main body of the oboe.

FIG. 1 is an illustration showing the exterior appearance of an oboe 1, which is an example of a woodwind instrument, in accordance with a preferred embodiment of the present invention. FIG. 2 is a longitudinal sectional view showing an upper joint of a pipe (or a main body) 2 of the oboe 1.

The oboe 1 includes the main body 2, a plurality of tone holes 3 arranged at prescribed positions of the exterior of the main body 2, and a key mechanism 4 for manually controlling the tone holes 3 to be opened or closed individually. The main body 2 is constituted by a plurality of pipes (or joints), namely, an upper joint (or a top joint) 5, a lower joint (or a bottom joint) 6, a bell joint 7, a reed tube 8, and a cane 9, which are integrally connected together. Metal rings (i.e., hoops) 10 are respectively attached to joint portions between the upper joint 5, the lower joint 6, and the bell joint 7 so as to improve connecting precision and strength and to prevent joint portions from being visually distinguished in appearance. The key mechanism 4 is constituted by a plurality of key posts 11 disposed on the exterior surface of the main body 2, a plurality of hinge tubes 12 whose opposite ends are axially supported between the key posts 11, a plurality of levers 13 connected to the hinge tubes 12, a plurality of arms 14, and a plurality of pad cups 15, which are connected to the hinge tubes 12 via the arms 14 so as to control the tone holes 3 to be opened or closed individually.

The oboe 1 is similar to conventionally-known oboes in that the main body 2 is produced using wood pipes, but the oboe 1 differs from them in that a plastic lining layer 16 composed of a thermoplastic material is formed on the overall interior wall of the main body 2 and the interior walls of the tone holes 3 integrally. The thickness of the plastic lining layer 16 ranges from 1 mm to 2 mm in order to ensure fluidity of the resin in injection molding. A prescribed portion of the plastic lining layer 16, which projects from the upper joint 5 (see FIG. 2), is a joint portion 16A used for interconnection with the lower joint 6.

It is preferable that the plastic lining layer 16 (composed of a thermoplastic material) be composed of generally-known plastics, which are easily melted and molded and which have suitability to mass production, such as polyethylene, polypropylene, polystyrene, acrylonitrile-butadiene-styrene (ABS) resin, and POM resin (polyoxymethylen, polyacethal, Delrin® (registered trademark of Dupont Co.), Duracon® (registered trademark of Polyplastic Co.)). Polyethylene has high impact resistance, high fluidity in molding, and high thermal stability, wherein it has a relatively low molding temperature (ranging from 90° C. to 110° C.) and a coefficient of contraction of 6/1000; hence, it is preferable for use in the plastic lining layer 16. The property of polypropylene is very similar to the property of high-density polyethylene, wherein polypropylene has a molding temperature ranging from 170° C. to 220° C. and a coefficient of contraction of 15/1000, which is higher than that of the polyethylene and polystyrene. Polystyrene is superior in molding ability, impact resistance, rigidity, and molding precision, wherein it has a molding temperature ranging from 130° C. to 150° C. ABS resin may not cause an unsatisfactory feeling in use of wind instruments; hence, it has been frequently used in recorders. POM resin has a relatively high specific gravity of 1.4, which is similar to that of grenadilla wood, wherein it is superior in chemical stability and cutting property.

Next, a manufacturing method of a woodwind instrument, i.e., the oboe 1, will be described with reference to FIGS. 3A to 3E.

Manufacturing steps will be described in such a way that the upper joint 5 serves as a wooden body of a product.

Figure 3A:
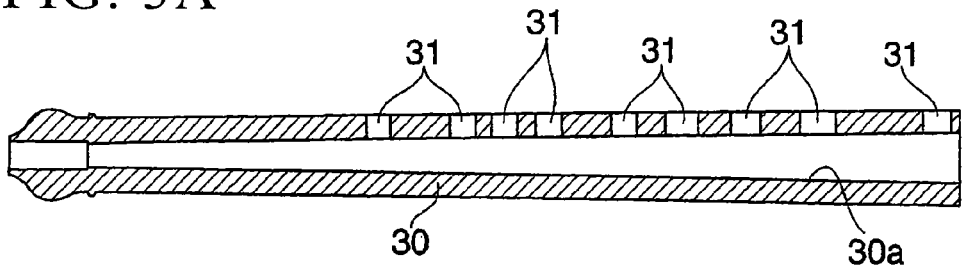
FIG. 3A is a longitudinal sectional view of a main body serving as an upper joint in connection with a first step of a manufacturing method of the oboe.

In a first step shown in FIG. 3A, a wooden body 30 is produced using a prescribed wooden material such as a grenadilla wood in such a way that the internal diameter thereof is larger than the inner diameter of the upper joint 5 (see FIG. 2 and FIG. 3E) and the external diameter thereof is substantially identical to the external diameter of the upper joint 5. A through-hole 30*a* substantially running through the center of the wooden body 30 in its longitudinal direction is formed in a tapered shape such that it is gradually broadened from the base end portion to the distal end portion. A plurality of precut tone holes 31 is formed at prescribed positions to vertically run through the exterior surface of the wooden body 30.

Figure 3B:
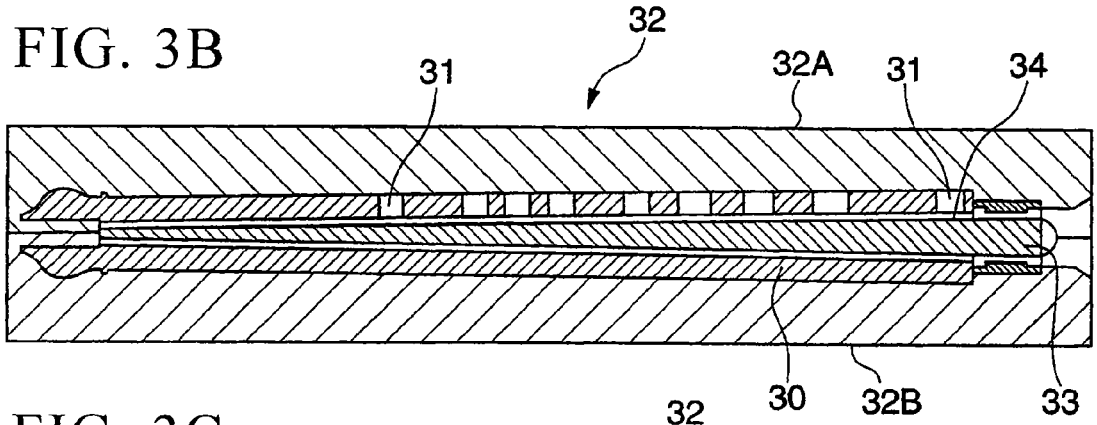
FIG. 3B is a longitudinal sectional view showing that the main body is put into a molding cast in connection with a second step of the manufacturing method of the oboe.

In a second step shown in FIG. 3B, the wooden body 30 is put into a molding cast 32 composed of an upper cast 32A and a lower cast 32B in an injection molding machine. A mandrel 33 is inserted into the through-hole 30*a* of the wooden body 30 in such a way that the axial line thereof substantially matches the axial line of the wooden body 30. The external diameter of the mandrel 33 is smaller than the internal diameter of the wooden body 30 and is substantially identical to the internal diameter of the upper joint 5, wherein the mandrel 33 is formed in a tapered-rod-like shape.

Figure 3C:
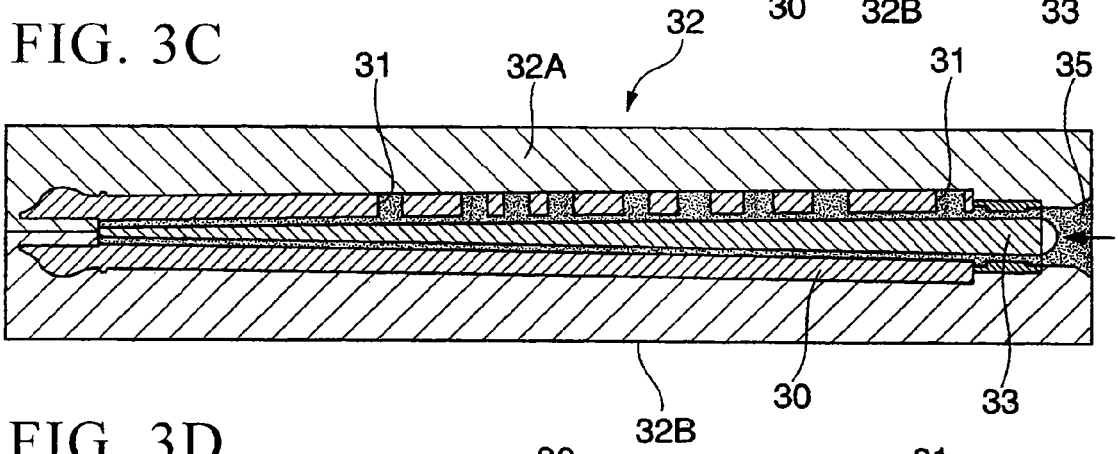
FIG. 3C is a longitudinal sectional view showing that a melted thermoplastic material is introduced into the molding cast holding the main body in connection with a third step of the manufacturing method of the oboe.

In a third step shown in FIG. 3C, a melted thermoplastic material 35 is introduced into a cavity 34, which is formed between the interior wall of the wooden body 30 and the exterior surface of the mandrel 33, and the precut tone holes 31 by way of a joint portion joining the lower joint 6 (not shown); then, it is hardened by cooling.

Figure 3D:
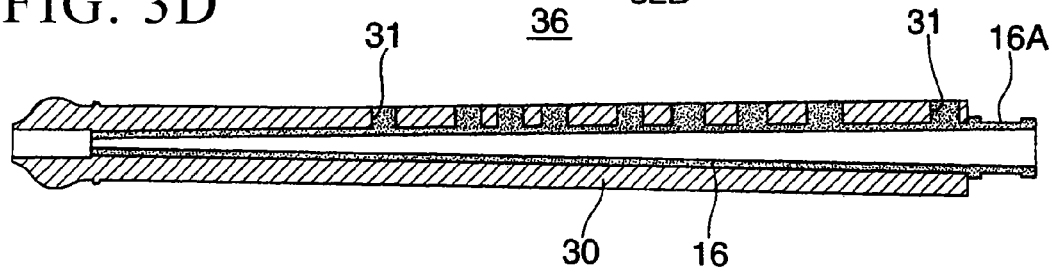
FIG. 3D is a longitudinal sectional view showing an insert molded product extracted from the molding cast in connection with a fourth step of the manufacturing method of the oboe.

In a fourth step shown in FIG. 3D, after completion of hardening of the thermoplastic material 35, the molding cast 32 is opened so as to extract an insert molded product 36 therefrom. In addition, the mandrel 33 is pulled out from the insert molded product 36. The insert molded product 36 is a semi-fabricated product of the upper joint 5, wherein the plastic lining layer 16 is formed on the interior wall of the wooden body 30, and the precut tone holes 31 are closed by the plastic lining layer 16. The joint portion 16A of the upper joint 5 is produced simultaneously with the insert molded product 36, wherein it projects externally from the opening of the lower joint 6 in connection with the wooden body 30.

Figure 3E:
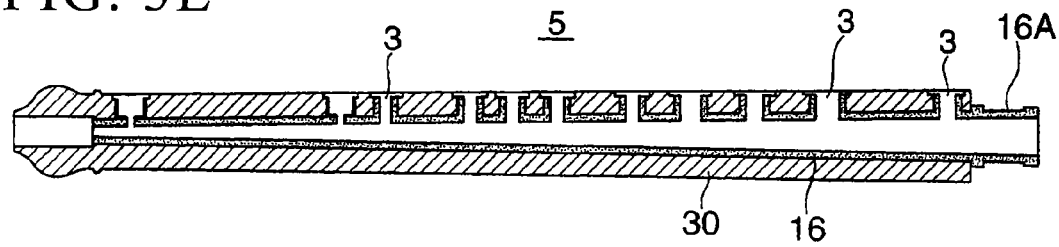
FIG. 3E is a longitudinal sectional view showing a final product of the upper joint, which is subjected to drilling work so as to form tone holes in connection with a fifth step of the manufacturing method of the oboe.

In a fifth step shown in FIG. 3E, the insert molded product 36 is put into a drilling machine (not shown), by which the precut tone holes 31 filled with the plastic lining layer 16 are drilled at the center positions thereof so as to form the tone holes 3, which communicate with the through-hole 30*a* of the wooden body 30. Due to the formation of the tone holes 3, resins remaining on the circumferential surfaces of the precut tone holes 31 serve as parts of the plastic lining layer 16. After all the precut tone holes 31 are completely drilled so as to form the tone holes 3, the exterior surface of the wooden body 30 is subjected to finish coating, thus completely producing the upper joint 5 having a desired shape and a desired appearance as shown in FIG. 3E. This completes the manufacturing of the upper joint 5.

It is possible to partially modify the manufacturing method in such a way that the tone holes 3 are formed simultaneously with the formation of the plastic lining layer 16. In this case, a plurality of rod-like projections are formed on the interior wall of the upper cast 32A, wherein the projections are inserted into the precut tone holes 31 of the wooden body 30, and then a melted lining plastic is introduced into gaps between the projections and the precut tone holes 31, thus forming the tone holes 3. This does not require the drilling machine, which drills the plastic lining layer 16 embedded in the precut tone holes 31 so as to form the tone holes 3. Thus, it is possible to reduce the number of steps in manufacturing.

According to the present embodiment, the plastic lining layer 16 is formed on the interior wall of the through-hole 30*a* of the wooden body 30; hence, it is possible to reduce absorption of water due to a player's breath on the interior wall of the upper joint 5. Since the interior wall of the upper joint 5 does not absorb water, the inside of the upper joint 5 does not expand so as to prevent tensile stress from occurring on the exterior surface of the upper joint 5 in its circumferential direction; hence, it is possible to avoid the occurrence of cracks. Since expansion due to moisture content does not occur, the internal diameter of the upper joint 5 does not vary; hence, it is possible to stably maintain desired playing performance. Since no cracks or flaws occur, it is possible to stably maintain the operating precision of the key mechanism 4; thus, it is possible to improve the durability of the oboe 1.

The prescribed parts of the plastic lining layer 16 formed relative to the circumferential surfaces of the tone holes 3 are formed simultaneously with the other portion of the plastic lining layer 16 formed relative to the through-hole 30*a* of the wooden body 30. That is, all parts of the plastic lining layer 16 can be simultaneously formed by way of a single operation of injection molding. This reduces the manufacturing cost.

Due to the formation of the plastic lining layer 16 relative to the circumferential surfaces of the tone holes 3, when pads attached to the pad cups 15 close the tone holes 3, they come in tight contact with the plastic lining layer 16. This makes it possible to close the tone holes 3 in a highly airtight manner, thus it is possible to prevent a player's breath from being unexpectedly leaked from the closed tone holes 3.

Since the plastic lining layer 16 is composed of a thermoplastic material, it is possible to perform injection molding with ease, and it is possible to provide high suitability to mass production. In particular, when the partial volume ratio of the plastic lining layer 16 within the total volume of the upper joint 5 is set to 10% or so, it is possible to realize a very high sound quality compared with another main body completely composed of plastics.

In the present embodiment, the prescribed parts of the plastic lining layer 16 are formed relative to the circumferential surfaces of the tone holes 3 as well; but this is not a restriction. Alternatively, a main body having no precut tone hole is produced; then, the plastic lining layer 16 is formed on the interior wall of the main body having a through-hole; thereafter, the main body is subjected to drilling work so as to form the tone holes 3 having prescribed diameters.

In the description, the aforementioned manufacturing method is applied to the upper joint 5 of the oboe 1. Of course, it can be similarly applied to the lower joint 6 and the bell joint 7. In addition, the present embodiment can be applied to pipes of other woodwind instruments (other than oboes) such as clarinets and piccolos.

Lastly, the present invention is not necessarily limited to the present embodiment and manufacturing method, which can be further modified in a variety of ways within the scope of the invention as defined by the appended claims.

What is claimed is:

1. A manufacturing method of a pipe of a woodwind instrument, comprising the steps of:

forming a main body having a through-hole running therethrough in a longitudinal direction, wherein an interior diameter of the main body is larger than an interior diameter of the pipe and an external diameter of the main body is substantially identical to an external diameter of the pipe;

inserting a mandrel having a rod-like shape whose diameter substantially matches the internal diameter of the pipe into the through-hole of the main body such that an axial line thereof substantially matches an axial line of the main body;

injecting a melted thermoplastic material into a cavity formed between the interior wall of the main body and an exterior surface of the mandrel;

hardening the melted thermoplastic material so as to form a plastic lining layer on the interior wall of the main body; and extracting the mandrel from the main body.

2. The manufacturing method of a pipe of a woodwind instrument according to claim 1, wherein a plurality of precut tone holes are formed at prescribed positions of the main body and filled with the melted thermoplastic material, said manufacturing method further comprising the step of:

after extracting the mandrel from the main body, extracting the melted thermoplastic resin, which is hardened and embedded in the plurality of precut tone holes, so as to form a plurality of tone holes of the pipe.

* * * * *